United States Patent [19]

Ozawa

[11] Patent Number: 4,641,113

[45] Date of Patent: Feb. 3, 1987

[54] DELAY LINE DEVICE HAVING SYMMETRICAL DELAY PATH

[75] Inventor: Juichiro Ozawa, Kyoto, Japan

[73] Assignees: Susumu Industrial Co., Ltd., Kyoto, Japan; Thin Film Technology Corporation, North Mankato, Minn.

[21] Appl. No.: 606,292

[22] Filed: May 2, 1984

[30] Foreign Application Priority Data

May 2, 1983 [JP] Japan ..... 58-78063

[51] Int. Cl.[4] ..... H01P 9/00

[52] U.S. Cl. ..... 333/161; 336/200

[58] Field of Search ..... 333/161, 185, 156, 246, 333/140; 336/200, 232; 307/601, 606; 328/56, 55

[56] References Cited

U.S. PATENT DOCUMENTS

| | | | |
|---|---|---|---|
| 1,767,715 | 6/1930 | Stoekle | 336/200 X |
| 2,542,726 | 2/1951 | Sullivan | 333/185 X |
| 2,768,357 | 10/1956 | Lyons | 336/232 X |
| 2,843,829 | 7/1958 | Slate | 336/200 |
| 3,670,270 | 6/1972 | Storey, II | 333/101 |
| 4,494,100 | 1/1985 | Stengel et al. | 336/200 |

FOREIGN PATENT DOCUMENTS

| | | | |
|---|---|---|---|
| 1392153 | 2/1965 | France | 333/161 |
| 0023002 | 3/1981 | Japan | 337/161 |
| 81/03087 | 10/1981 | PCT Int'l Appl. | 337/156 |
| 0423721 | 2/1935 | United Kingdom | 333/185 |
| 0632834 | 12/1949 | United Kingdom | 333/161 |
| 0767077 | 1/1957 | United Kingdom | 333/161 |

*Primary Examiner*—Paul Gensler
*Assistant Examiner*—Benny Lee
*Attorney, Agent, or Firm*—Berman, Aisenberg & Platt

[57] ABSTRACT

A delay line device comprises a transmission path formed by a thin film of an electrically conductive material on one surface of a substrate in a zigzag-shape in plan view and a ground electrode formed on another surface of the substrate to provide an inductance part and a capacitor part similar to an ideal distributed parameter circuit. The delay line device has a sufficiently high characteristic impedance for transmitting a high speed pulse signal with low distortion.

3 Claims, 5 Drawing Figures

DELAY LINE DEVICE HAVING SYMMETRICAL DELAY PATH

FIELD OF THE INVENTION

The present invention relates to a delay line device for use in a pulse signal circuit for delaying timing of a pulse or pulses.

BACKGROUND OF THE INVENTION

In a signal transmission line having an inductance value L and a capacitance value C, a transmission delay time $T_p$ is generally defined by:

$$T_p=\sqrt{L\times C}$$

The characteristic impedance $I_c$ thereof is defined by:

$$I_c=\sqrt{\frac{L}{C}}$$

Where a time adjustment of a pulse signal is necessary by delaying the timing of the pulse signal by a predetermined value, it is known to use a delay line device having a suitable inductance L and a distributed capacitance C calculated from the above relation. When a circuit arrangement made by merely connecting an inductance element to distributed capacitors is used, the circuit arrangement acts as a resonance circuit and the wave form of the signal transmitted through the circuit is distorted. To avoid this, a cascade circuit having a plurality of inductance elements and a plurality of distributed capacitors connected in a cascade manner is used to suppress the resonance effect.

A delay line of a distributed parameter circuit type is an ultimate form of the circuit arrangement adopting the idea of the above-mentioned technique.

When dealing with relatively slow signals, e.g., the rise time and the fall time of the signals are relatively long, a conventional delay line of the cascade type formed by a plurality of discrete inductive elements and a plurality of distributed capacitors is a practical delay line system. However, when dealing with relatively high speed pulse signals having a rise time or fall time shorter than a nano second, delay lines having nearly the ideal distributed parameter elements for controlling the delay time of a high speed pulse signal are desired. In addition, it is desired to provide delay line systems with a smaller size and a higher accuracy.

SUMMARY OF THE INVENTION

The essential object of the present invention is to provide a delay line device which is able to delay a high speed pulse signal without distortion of the wave form.

A ceramic substrate has a zig-zag conductive path on one side and a ground electrode on an opposite side. Layers of a nickel-chromium alloy (Nichrome) are placed between the conducting path and the substrate and between the ground electrode and the substrate.

Another object of the present invention is to provide a delay line device of a small size and a high degree of integration.

A still further object of the present invention is to provide a delay line device which is manufactured easily and rapidly with a high degree of accuracy.

A still further object of the present invention is to provide a delay line device having a sufficient characteristic impedance in a small size chip.

DETAILED DESCRIPTION OF THE INVENTION

Figure 1:
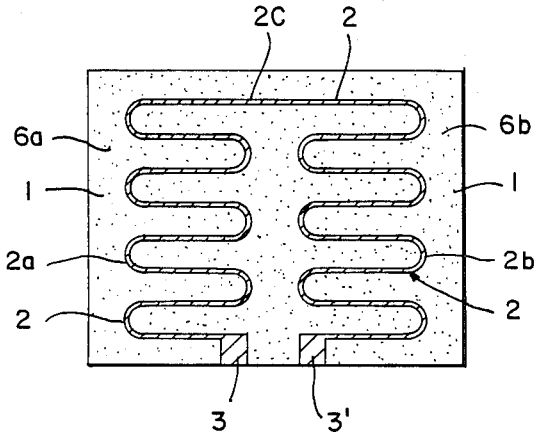
FIG. 1 is a top plan view showing one embodiment of a delay line device according to the present invention.
Figure 2:
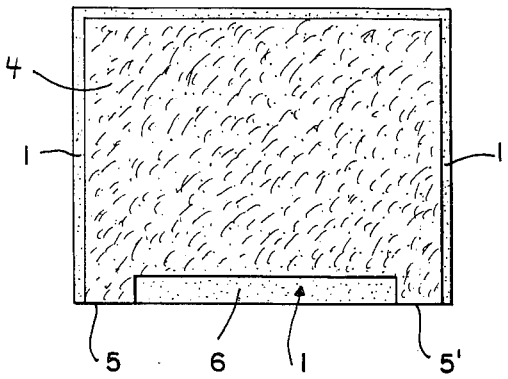
FIG. 2 is a bottom plan view of the device shown in FIG. 1.
Figure 3:
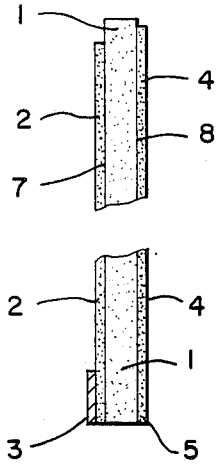
FIG. 3 is a side elevation view of the device shown in FIG. 1.

Referring to FIGS. 1–3 of the drawings, an electric signal transmission path 2 is formed by a thin film member of an electrically conductive material in a zigzag form on one surface of a ceramic substrate 1. A pair of connecting electrodes 3 and 3' are formed by a thin film technique and are connected to respective ends of the thin film member. A ground electrode 4 is formed by a thin film of an electrically conductive material on another surface of the ceramic substrate 1 over almost all of the surface of the substrate 1, except for the elongated rectangular part 6 which is exposed. A pair of connecting electrodes 5 and 5' are formed on side edge portions of the substrate 1.

In the preferred embodiment a Nichrome layer 7 underlies path 2 and Nichrome layer 8 underlies ground electrode 4.

Referring to FIG. 1 again, the transmission path 2 is formed by two zigzag-shaped portions **2*a* and 2*b* located symmetrically on the left half portion 6*a* and the right half portion 6*b* of the substrate 1. The ends of the zigzag-shaped portions 2*a* and 2*b* are connected by a generally straight conductor part 2*c***. This configuration of the transmission path is used to provide a negative parallel impedance when the mutual inductive coefficient "m" is larger than 1.

Figure 4:
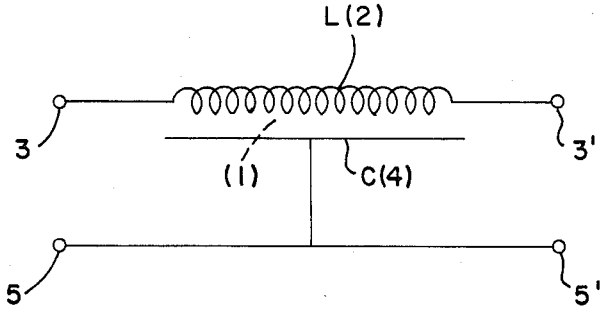
FIG. 4 is a circuit diagram showing one example of an equivalent circuit of the delay line device shown in FIG. 1.

As shown in FIG. 4, the transmission path 2 is represented by the inductance part L, and the ground electrode 4 is represented by capacitor part C. Each of the parts acts as a distributed parameter element. It can be seen that the ceramic substrate 1 is interposed between the inductance part L and the distributed capacitor C. In other words, it can be assumed that the capacitors are distributed along the transmission path 2, and the delay line device shown in FIG. 1 can be represented by the equivalent circuit elements as shown in FIG. 4.

According to the present invention, the transmission delay time $T_p$ and the characteristic impedance $I_p$ can be determined as desired depending on the shape of the zigzag pattern of the transmission path 2, the thickness of the substrate, and the material of the substrate 1.

The delay time of the present invention is formed on a ceramic substrate which has excellent stability and a small expansion coefficient. Ceramic is used as the substrate material to serve as an electrical insulator with various dielectric and magnetic permeability constants. A preferred ceramic material is aluminum oxide. Other materials, such as Ferrite oxide and titanium oxide may be used.

It is thus possible to provide a delay line device in which the operational characteristic is stabilized with high reliability. Further, the delay line device according to the present invention enables transmission of a signal with minimum distortion of the signal wave form where the signal rise time is less than 1 nano second, in an operation area of less than a few nano seconds. Further, since the delay line device according to the present invention is preferably formed by a thin film technique, the characteristic accuracy is very high and the size of the delay line device can be extremely reduced. It is also possible to manufacture a significant number of delay line devices of the invention on one ceramic substrate, thereby decreasing the production cost.

The following process was used to produce a delay line device in accordance with the invention and is illustrative.

A ceramic substrate having an area of approximately 25.4 mm×7.5 mm with a thickness of 0.4 mm was used. Nichrome (Ni:Cr) layers were formed on opposed faces of the substrate by vacuum evaporation. Then, thin copper layers were formed on the Nichrome layers by vacuum evaporation. A photo resist material was coated on one of the surfaces of the substrate over the copper layer. The photo resist material was exposed using a mask having an opening in the shape of a zigzag for the transmission path. The exposed photo resist was developed, thereby eliminating the resist layer in the zigzag-shaped portion for the transmission path.

Copper layers were then coated by electroplating on both surfaces of the substrate using copper sulfate. This formed the transmission path of zigzag-shape by a copper film on one surface of the substrate, and another copper film was formed over substantially the entire other surface of the substrate to provide the ground electrode. The portion still having photoresist material on it did not receive a copper layer during electrodeposition. Subsequently, the resist layer on the surface having the zigzag-shaped portion was removed by a stripping process, and the copper layer and the nichrome layer were eliminated, thereby causing the surface of the substrate to be exposed except for the zigzag-shaped portion of the transmission path. During removal of the deposited copper and Nichrome layers, the outermost surface portions of the thicker electroplated copper layers of the ground electrode and the transmission path were also slightly etched.

Subsequently lead wires were connected with the respective connecting electrodes.

By the above process a delay line device according to the present invention was made with a transmission path of thin copper film having a width of 0.23 mm±1.0 micron and a thickness of 40 micron on one surface of the substrate and a ground electrode of a thin copper film layer of a thickness of 40 micron on another surface. The delay line device was enclosed by a resin coating for waterproofing.

The D.C. resistance across the connecting electrodes 3 and 3' was 0.3 ohm. A pulse having a rise time $T_R$ of 700 pico second, a pulse width $W_p$ of 10 nano second and a fall time $T_F$ of 700 pico second was applied to one of the connecting terminals 3, and this pulse was transmitted to the connecting electrode 3' without changing any values of the rise time $T_R$, the pulse width $W_p$ and the fall time $T_F$. Furthermore, none of an overshoot and a ringing occurred on the pulse received at the connecting electrode 3'. The wave form distortion due to the electrode reflection was limited and less than 5%. The transmission delay time was 1.2 nano second and the characteristic impedance was 50 ohm with a fluctuation less than ±5%.

Figure 5:
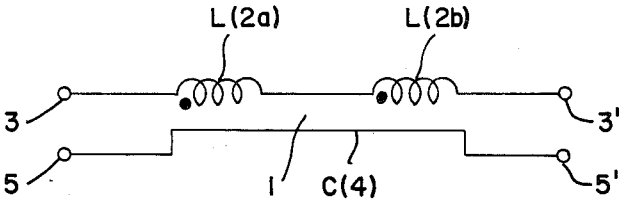
FIG. 5 is a circuit diagram showing another example of an equivalent circuit of the delay line device shown in FIG. 1.

It is noted that by forming the Nichrome layers on both surfaces of the substrate, the Nichrome layers act as cores disposed near the inductive elements having a high resistance and a low eddy current loss. This increases the inductance L and Q, whereby a relatively large inductance L can be obtained with a relatively short transmission path, resulting in a large characteristic impedance with a small capacitance C between the inductive element and the ground electrode. In this case, the delay line device shows the characteristic of a so-called m-derived device, with m greater than 1 to realize a negative parallel impedance, and the equivalent circuit of the device can be presented as in FIG. 5.

The delay line device mentioned as above has a high cut off frequency with a large delay time.

Although the present invention is described with reference to the preferred embodiments, various modifications can be made to those skilled in the art without departing from the scope of the present invention. For example, the shape of the zigzag portion for the transmission path may be selected as desired.

What is claimed is:

1. A delay line device which comprises a substrate made of an electrically insulating material, a transmission path formed by a thin film containing copper on one surface of the substrate, said transmission path including at least two parts arranged in a symmetrical manner, and a ground electrode formed on another opposing surface of the substrate, each of said parts being of a zig-zag configuration comprising a plurality of generally straight sections connected by a plurality of bent sections, said parts being adjacent each other and symmetrical about an axis intermediate said parts and extending in a direction perpendicular to said generally straight sections, the uppermost straight sections of said parts being contiguous and electrically connected, first connecting electrodes formed adjacent the lower most straight sections on said one surface of the substrate and respective ones of said first electrodes being connected with a respective end of the transmission path, and second connecting electrodes formed on said another opposing surface of the substrate and connected with portions of the ground electrode, said second connecting electrodes being spaced from each other.

2. The delay line device according to claim 1, further comprising two layers of an alloy of nickel and chromium, a first of said layers being formed between the ground electrode and the substrate and a second of said layers being formed between the transmission path and the substrate.

3. The delay line device according to claim 1, wherein the ground electrode covers substantially the entire said another opposing surface of the substrate.

* * * * *